US005401077A

United States Patent [19]

Hosoe

[11] Patent Number: 5,401,077

[45] Date of Patent: Mar. 28, 1995

[54] ERGONOMICALLY IMPROVED CHAIR OR ARMCHAIR

[76] Inventor: Isao Hosoe, Via Voghera, 11, Milano, Italy

[21] Appl. No.: 104,133

[22] PCT Filed: Feb. 20, 1992

[86] PCT No.: PCT/IT92/00018

§ 371 Date: Aug. 12, 1993

§ 102(e) Date: Aug. 12, 1993

[87] PCT Pub. No.: WO92/14386

PCT Pub. Date: Sep. 3, 1992

[30] Foreign Application Priority Data

Feb. 20, 1991 [IT] Italy ..... MI91A0432 U
Feb. 20, 1991 [IT] Italy ..... MI91A0433 U

[51] Int. Cl.[6] ..... A47C 1/032; A47C 3/026; A47C 7/54

[52] U.S. Cl. ..... 297/312; 297/316; 297/321; 297/344.19

[58] Field of Search ..... 297/312, 316, 321, 322, 297/344.15, 344.16

[56] References Cited

U.S. PATENT DOCUMENTS

| | | | |
|---|---|---|---|
| 3,446,532 | 5/1969 | Cramer | 297/312 |
| 4,380,352 | 4/1983 | Diffrient | 297/312 X |
| 4,521,053 | 6/1985 | de Boer | 297/312 |
| 4,695,093 | 9/1987 | Suhr et al. | 297/312 X |
| 4,848,837 | 7/1989 | Völkle | 297/316 X |

FOREIGN PATENT DOCUMENTS

89/06101 7/1989 WIPO .

*Primary Examiner*—Richard E. Gluck

[57] ABSTRACT

An ergonomical chair is provided, of the type which is adjustable in height, whose seat has a front portion with a slope automatically changeable as a function of the height adjustment. The seat rear portion remains substantially horizontal, irrespective of the height adjustment and the consequent tilting of the front portion, thus avoiding the downward sliding of the body which can stay in its erect or slightly backward bent position, while a correct leaning of the seat front portion of the lower region of the thighs is ensured without exerting any tiring action by the user. Another embodiment of the invention has armrests and backrest adjustable integrally with each other.

12 Claims, 6 Drawing Sheets

ERGONOMICALLY IMPROVED CHAIR OR ARMCHAIR

BACKGROUND OF THE INVENTION

The present invention relates to an ergonomic chair adjustable as to the height having a seat front portion tiltable as a function of said height adjustment.

It is known that chairs or armchairs for use in an office or the like are often provided with a function allowing the height of a seat portion to be freely changed in accordance with the physique of a sitting person, the height of a desk employed and so forth. It is known as well that chairs having a swingable backrest exist in which a seat front portion can be tilted downwards, thus avoiding the raising of the user's legs, either in a suitable adjustable way, or because said portion is hinged freely with respect to the rest of the seat and it can be lowered by means of a certain pressure exerted by a lower region of the thighs of the user himself. There are also chairs in which a seat front portion is permanently tilted downwards with a fixed angle, but clearly without any utility, as it results in a shorter seat, i.e. lacking said front portion.

From WO-A-8906101 of the present applicant another ergonomic chair is known, adjustable in height, in which the tilting angle of the whole seat changes as a function of the seat height by swinging along an arc of circumference about a center of rotation substantially coincident with the center of gravity of a person sitting on the chair itself. In that case the effect is very comfortable, however the problem remains unsolved in that, as the slope of the whole seat with respect to the backrest is changed as a function of the height of the seat itself, the user is necessarily caused to exert, in case of considerable tilting angles, a certain force on the rest areas in order to avoid a downward sliding along an inclined plane formed by the seat itself, in spite of the fixed position of the center of gravity. Thus the user must exert a pressure both on the floor by his feet and on the seat rear portion by his ischial region in order to stay in a balanced position, which may involve some discomfort and a non-negligible fatigue.

U.S. Pat. No. 4,521,053 discloses a chair whose seat is adjustable as to the height and which is formed in two portions, the front portion of which is downwardly tiltable with respect to the rear portion to which it is hinged. However, the tilting angle is to be chosen at will by the user who has to exert a pressure on the front part of the seat with his thighs until finding the preferred, most comfortable tilting angle.

It is also known that a great number of chairs, especially for use in an office and particularly suitable for typists and computer operators, or also for meeting-rooms and the like, have a backrest adjustable as to the height to keep correct, in accordance with the user's stature, the resting of the back, which takes place in the lumbar vertebrae region. By means of ergonomic research it was found that such height corresponds to a third of the height of a sitting person's trunk.

It is also known that the armrests of the chairs having same are preferably adjustable in height, either integrally to each other or independently, in order to ensure a correct leaning of the sitting person's elbows. However, it is necessary, to the aim of reaching an ergonomically valid result and to avoid uncomfortable postures, which are tiring so as to cause, in time, physical malformations, that the armrests adjustment is combined with a backrest adjustment as a function of the stature of the chair user. Naturally it is not easy to adjust armrests and backrests separately, based on both the difficulty of the operation to be executed, and the uncertainty of the obtained result, which often can involve additional adjusting operations.

SUMMARY OF THE INVENTION

It is the main object of the present invention to provide a chair, of the type which is adjustable in height, and possibly having a swinging backrest, whose seat has a front portion with a slope automatically changeable as a function of the height adjustment, thereby overcoming the drawbacks which remain unsolved by means of the solutions given by the prior art, such that the seat rear portion remains substantially horizontal, irrespective of the height adjustment and the consequent tilting of the front portion. As a result, the downward sliding of the body is avoided, since the body can stay in its erect or slightly backward bent position, while a correct leaning of the seat front portion to the lower region of the thighs is ensured without exerting any tiring action by the user.

In particular, the tilting angle of the seat front portion may change with the height of the seat itself following a ratio that can be modified at will by an adjustment to be executed once and for all by the user in function of his height, or every time as it is required by particular circumstances to let the user assume a more comfortable position.

To solve this second problem the present invention intends to make use of the surprising observation made by the present inventor after various antropometric measurements, that the difference between the height of the lumbar leaning zone, equivalent to a third of the height of a sitting person's trunk, and the height of the elbow lower region or leaning region on the armrests, in the great majority of the cases is substantially constant for people having different stature.

Thus according to a particular aspect of the present invention a chair having both armrests and backrest adjustable integrally to each other has been conceived, such to maintain constant the difference between the heights of respectively the armrest and the zone for the lumbar leaning, with respect to the seat.

BRIEF DESCRIPTION OF THE DRAWING

These and other objects, advantages and characteristics of the present invention will be .clearer from the following detailed description with reference to the annexed drawings in which.

DETAILED DESCRIPTION OF THE INVENTION

Figures 1A, 1B:
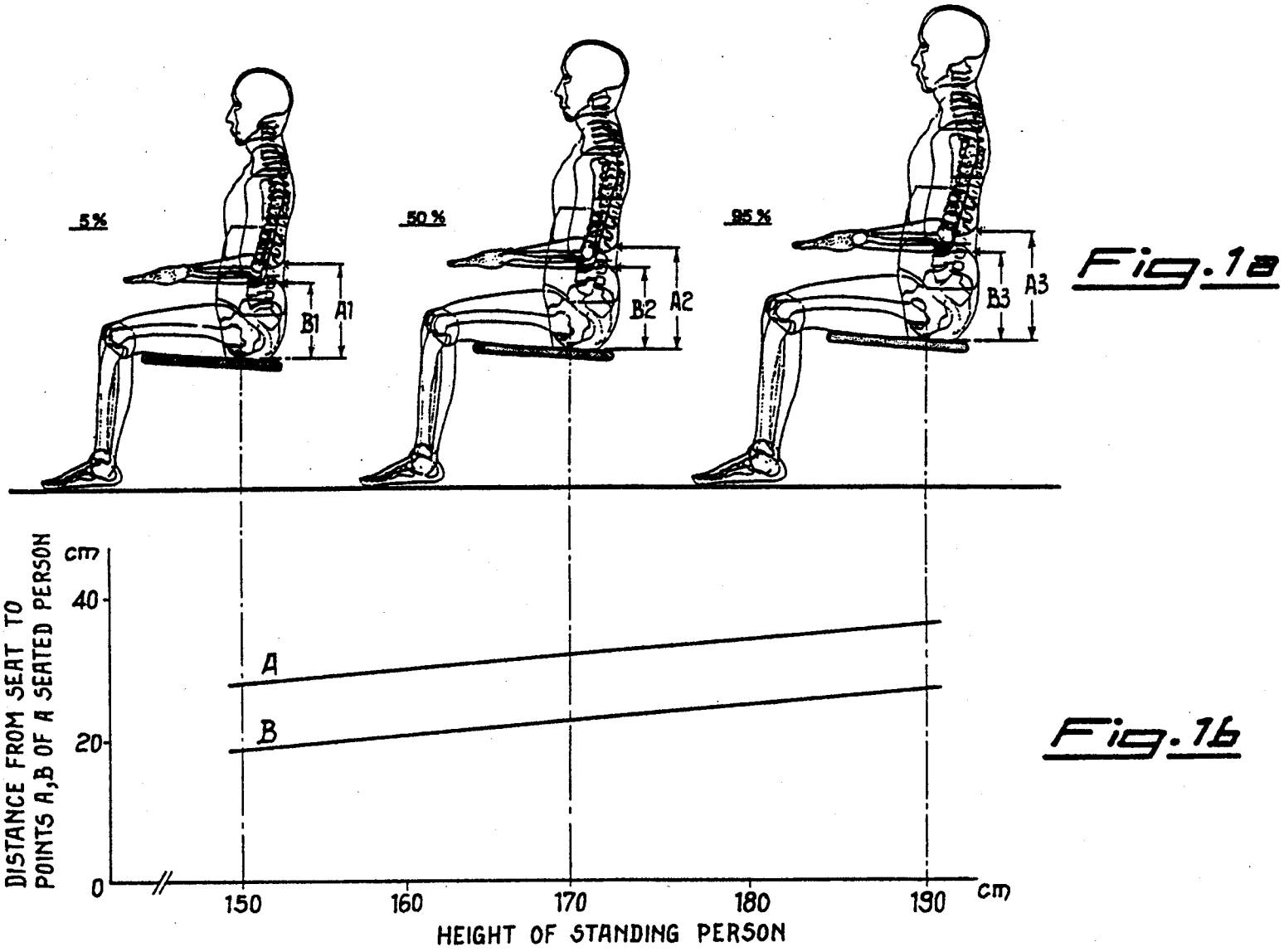
FIGS. 1*a* and 1*b* represent respectively three people of different stature and sitting on a seat adjustable in height for maintaining optimum ergonomic conditions, and a diagram which represents, as the person's stature increases, the height of the lumbar leaning region, computed as a third of the trunk height, and the height at which the armrest must be adjusted for a correct posture of the sitting person.

In FIG. 1*a* three people are shown, sitting on a seat of a chair adjustable in height, and respectively of a small, medium and great stature which may correspond to heights of about 150, 170 and 190 cm. It can be considered that only 5% of adult people have a stature lower than the considered minimum of 150 cm and likewise only 5% of them are taller than the considered maximum of 190 cm. For each of the three people represented, A denotes the height from the seat, i.e. from the respective ischiatic region leaning on the seat, of the respective lumbar region that leans on the backrest, which height, according to antropometric considerations, is assumed equivalent to a third of the full height of a sitting person's trunk. Furthermore B denotes the height of the elbow from the seat, corresponding to the height which the adjustable armrest should assume in accordance with the person's stature.

Figure 2:
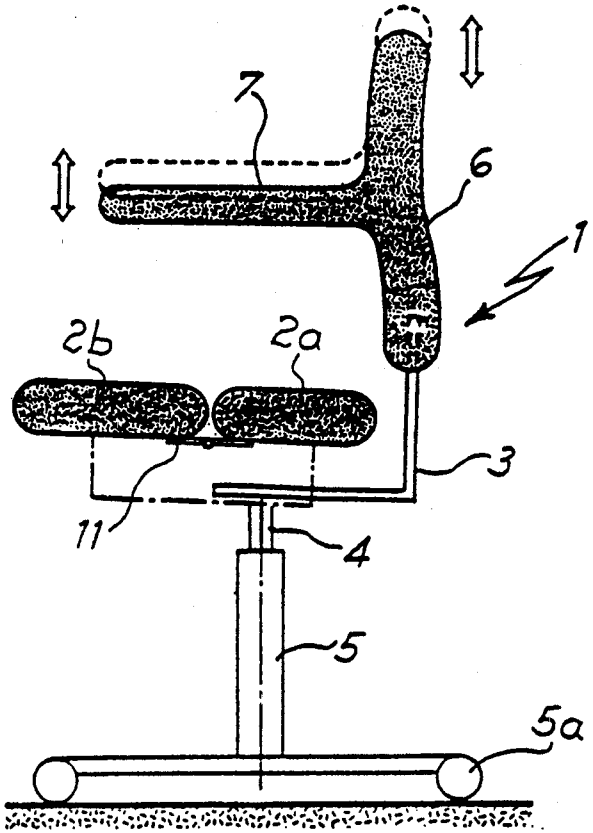
FIG. 2 shows a schematic view of a chair having adjustable armrests and backrest according to the present invention.

FIG. 1*b* shows the diagrams of the variation of values A and B as a function of a person's stature, valid at least within the above-cited limits of 150–190 cm, thus leaving out only the people having a percentile of less than 5% and higher than 95%. As it can be seen in FIG. 1*b*, the difference between the values A and B corresponding to a certain stature is always constant, at least within the above-mentioned limits. Therefore an adjustment which maintains constant this difference is perfectly consonant with the anthropometric data and ergonomic requirements of a sitting person and this can be carried out for instance by maintaining integral to each other the backrest and the armrests, which can be formed in a single piece as shown in FIG. 2. Referring to this figure, a chair 1 is shown having a supporting base 5 mounted on castors 5*a*, with respect to which the chair is adjustable in height by means of an adjustment post 4, a supporting structure 3 which bears a seat 2 and a backrest 6 with armrests 7. The seat 2 can be tiltable as a function of the adjustment height and backrest 6 can swing backwards but anyhow, according to the present invention, armrests 7 are formed in a single piece with backrest 6, and therefore an adjustment in height of the latter on supporting structure 3 involves the same variation in height for armrests 7 thus maintaining the relation required by the diagram in FIG. 1*b*.

The adjustment in height can be accomplished in any known way, for instance by a knob which blocks, at a desired height, the backrest 6 which can slide with respect to the vertical portion of supporting structure 3, but also providing an electric motor or a pump for a pressure adjustment. The embodiment in FIG. 2 is surely simple and practical, by allowing to adopt interesting solutions under the "design" view point, but anyway it remains an embodiment which involves a certain structural rigidity with a single piece having a certain encumbrance and intended to be replaced, when necessary, as a whole.

Figure 3:
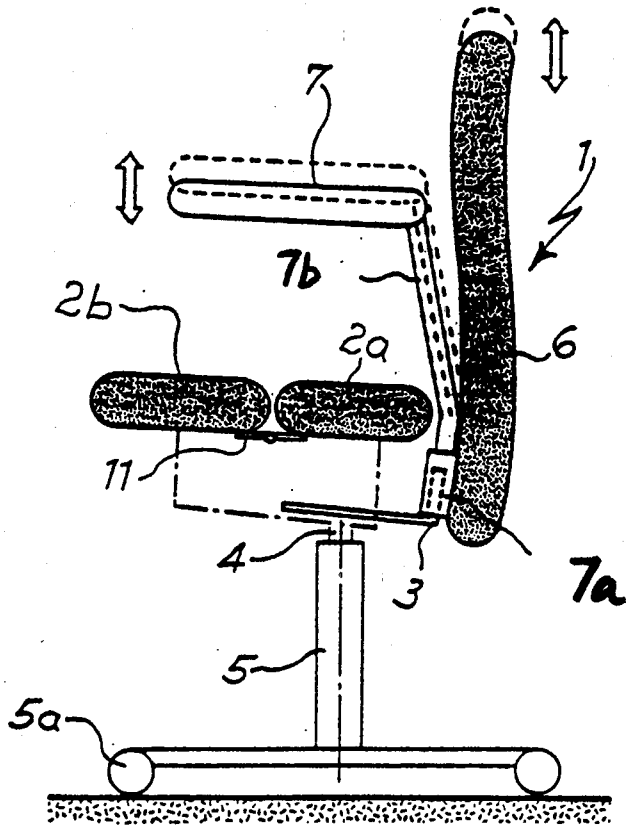
FIG. 3 shows a schematic view of a different embodiment of the adjustable chair according to this invention.

According to FIG. 3, wherein an adjustable chair is shown and components equal to those shown in FIG. 2 have been denoted by the same reference number, it is proposed an embodiment which provides a structural interface between backrest 6 and armrests 7, thus allowing the independence thereof. Such interface consists for instance of a sleeve 7*a* integral with backrest 6 and separately with supports 7*b* of the two armrests 7, whilst it is adjustable in height with respect to structure 3, against which it can slide and be blocked at a desired position. This allows to have the armrests independent from the backrest, and therefore a less bulky whole, as well as the possibility of separately inserting and removing them with the advantage of possibly replacing them irrespective of backrest 6. Obviously even this one could be possibly replaced, while maintaining the same armrests 7 after having removed sleeve 8 from structure 3.

Figure 4B:
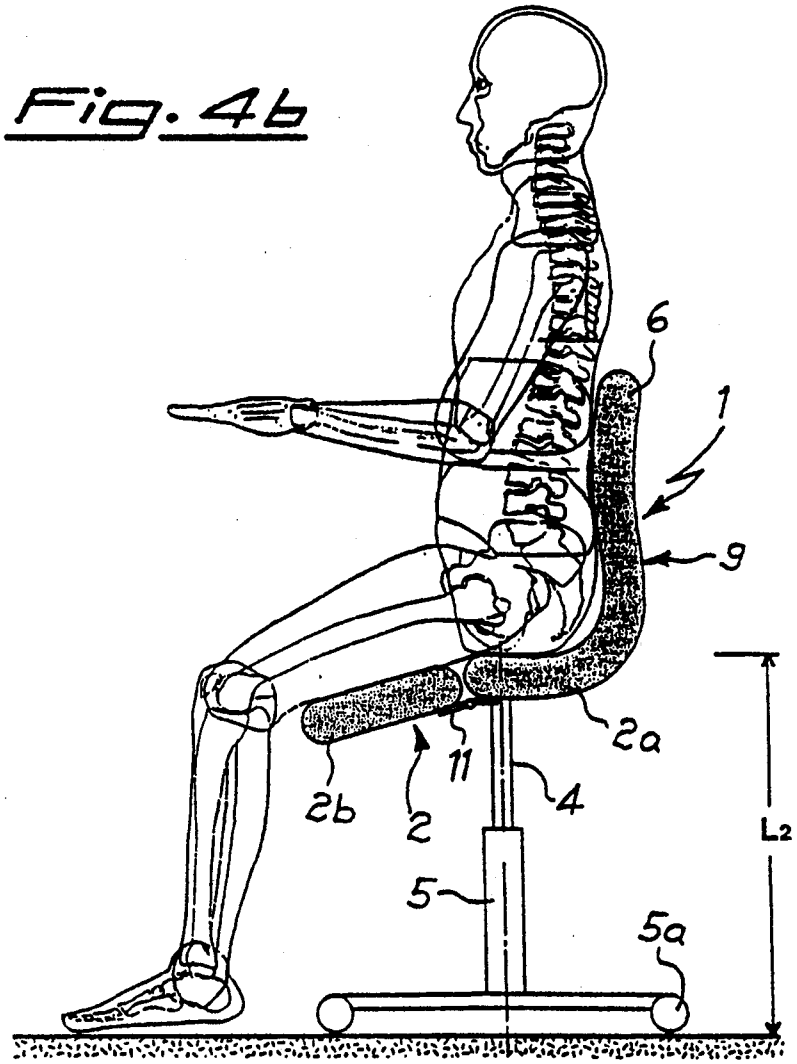
FIGS. 4*a* and 4*b* show how the seat position of a chair adjustable as to the height is changed, according to the invention, when the seat is adjusted at different heights for either the same person or people having the same stature.
Figure 4A:
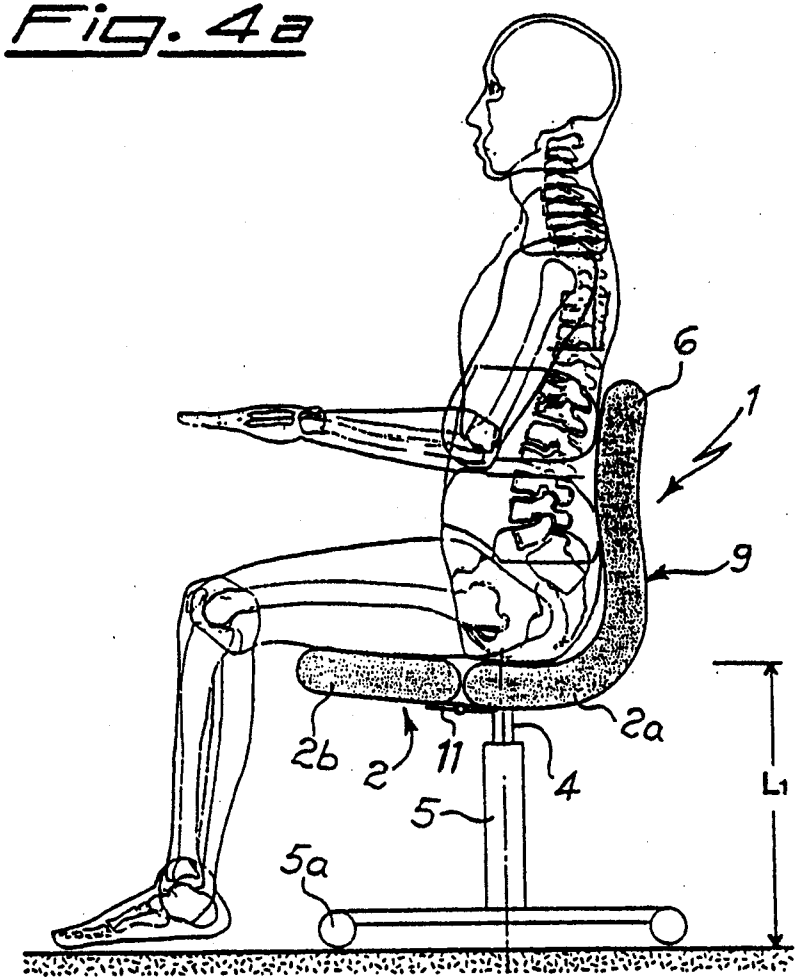

Referring now to FIGS. 4*a* and 4*b*, wherein the same numeral references are adopted for the same elements of FIGS. 1–3, a chair 1 is shown of the type adjustable as to the height and having a base 5 mounted on castors 5*a* and a vertical post 4 supporting a raisable portion 9 of the chair. The post 4 can be fixed in any known way, at different heights with respect to fixed base 5, thus causing to correspondingly raise and lower the portion 9 which consists of a backrest 6 and a seat rear portion 2*a* represented integral therewith, as well as a seat front portion 2*b* hinged to said portion 2*a* by a hinge element 11, thereby assuming a different slope with respect thereto. The chair seat 2 is comprised of said portions 2*a*, 2*b*.

As it is seen in FIGS. 4*a* and 4*b*, when the height of portion 9 increases, seat front portion 2*b*, initially horizontal or slightly tilted upwards in correspondence of the lowest position in FIG. 4*a*, tilts downwards, as shown in FIG. 4*b*, thus ensuring the feet to correctly rest on the floor and avoiding an excessive pressure of said portion 2*b* against the lower region of the user's thighs. Thus, when a person wants to take on a higher sitting posture, being for instance in front of a higher desk or work surface, he must only operate the usual height adjusting devices to obtain at the same time a correct tilting of the seat front portion 2*b*, as shown in FIG. 4*b*. At the same time the ischial region, on which a lot of the weight and the center of gravity itself of the person lean, will stay on the same vertical line of the seat rear side 2*a*, substantially horizontal or preferably integral with backrest 6, and then possibly with a slight backward tilting if the backrest can swing, anyhow without any downward and forward inclined component which would involve the sliding of the sitting person like on an inclined plane, thus forcing him to make an effort to balance himself. The automatic tilting of seat front portion 2*b* as a function of the height of portion 9 can occur in different ways, for instance simply by means of an arm hinged at one end on the fixed supporting base 5 and at the other end on the tiltable portion 2*b* itself. Therefore, as the height increases, e.g. from L1 to L2 (FIGS. 4*a* and 4*b*), the distance between said portion 2*b* and fixed base 5 would increase as well, whilst if these two portions are linked to each other by means of a rigid arm, the variation of the angle of the seat front side 2*b* with respect to the rear side 2*a* follows automatically.

Figure 5B:
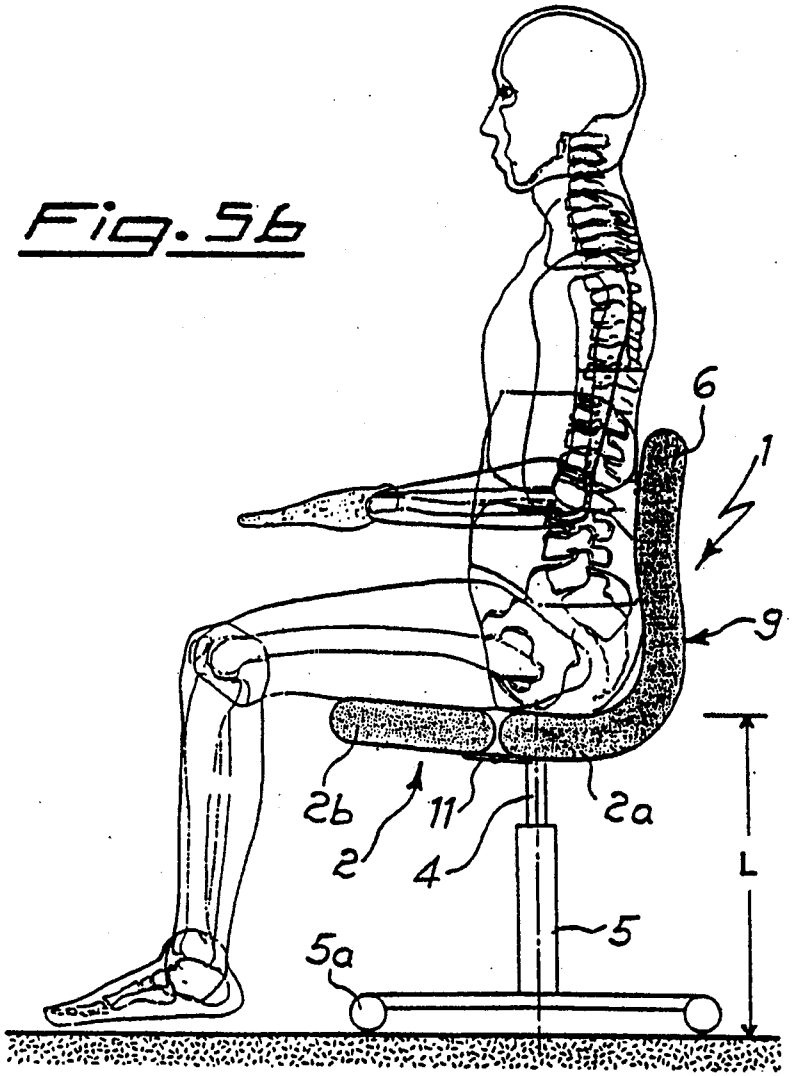
FIGS. 5*a* and 5*b* show the different positions that a seat can take on, according to an embodiment of the present invention, for two people having different height both sitting at the same height of the seat.
Figure 5A:
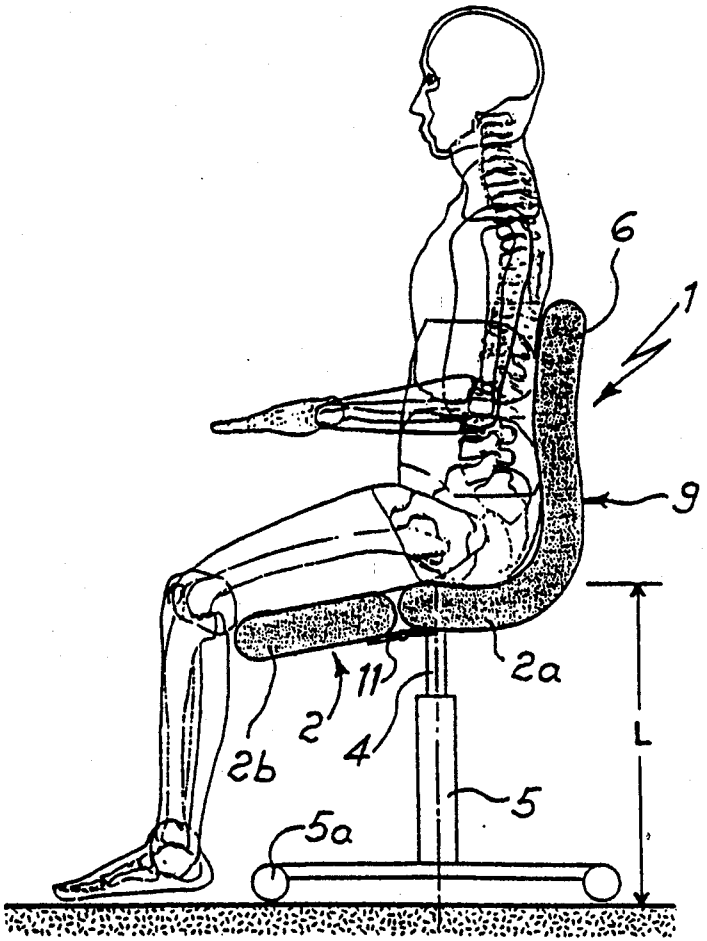

Referring to FIGS. 5*a* and 5*b*, it is shown the possibility, according to the present invention, to obtain a different slope of seat portion 2*b* at the same height L for two people having different height. In fact, while for the person in FIG. 5*b* the seat front portion 2*b* is perfectly lined-up with the other portion 2*a* in correspondence with a height L of the seat, for the smaller person in FIG. 5*a*, the same height L involves a tilting of front portion 2*b*, thereby still ensuring to lean on the floor his feet, which otherwise would remain raised, and to have a correct sitting posture. This is obtained by providing the personalized adjustment of the slope of the seat mobile portion 2*b*, in practice the possibility to change at will the length of said link arm which connects base 5 and portion 2*b* (FIGS. 6*a*–6*c*).

Figure 6C:
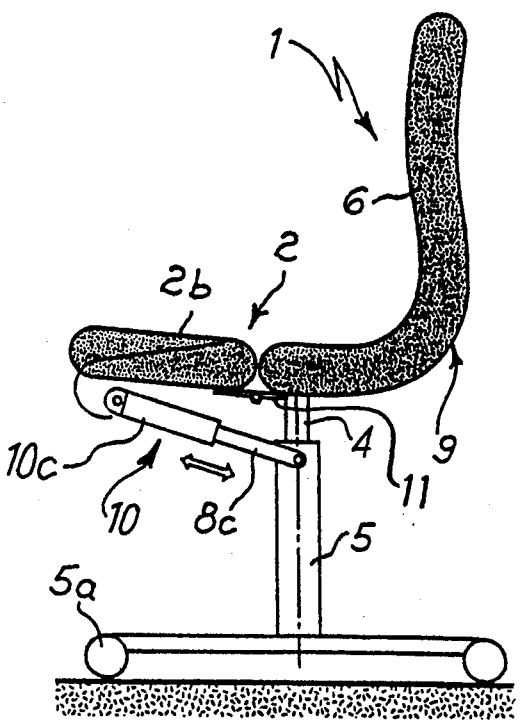
FIGS. 6*a*, 6*b* and 6*c* show respectively three different examples of how a personalized modification of the seat front portion slope as a function of the height, according to FIGS. 5*a*, 5*b*, can be accomplished.
Figure 6B:
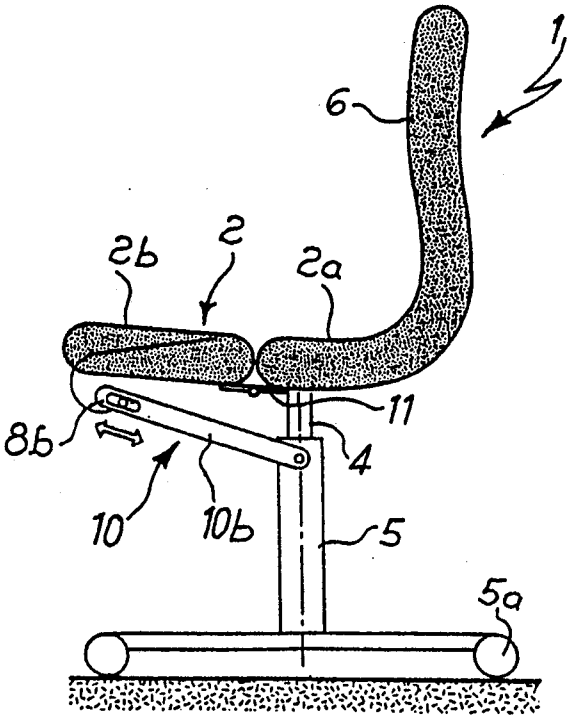
Figure 6A:
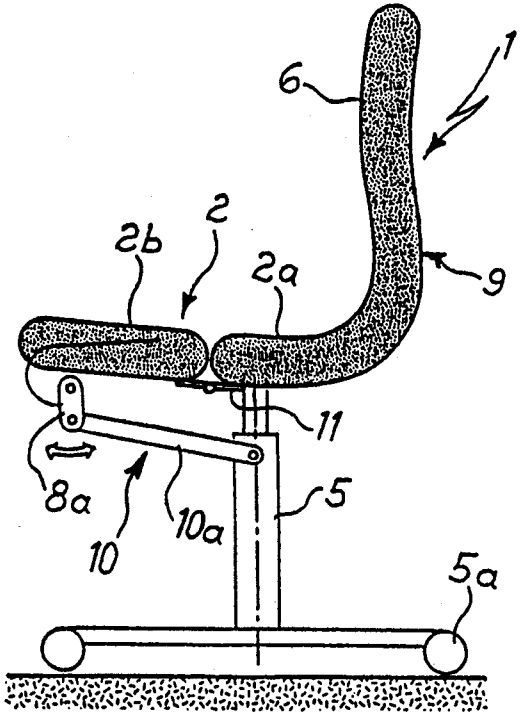
Figure 7:
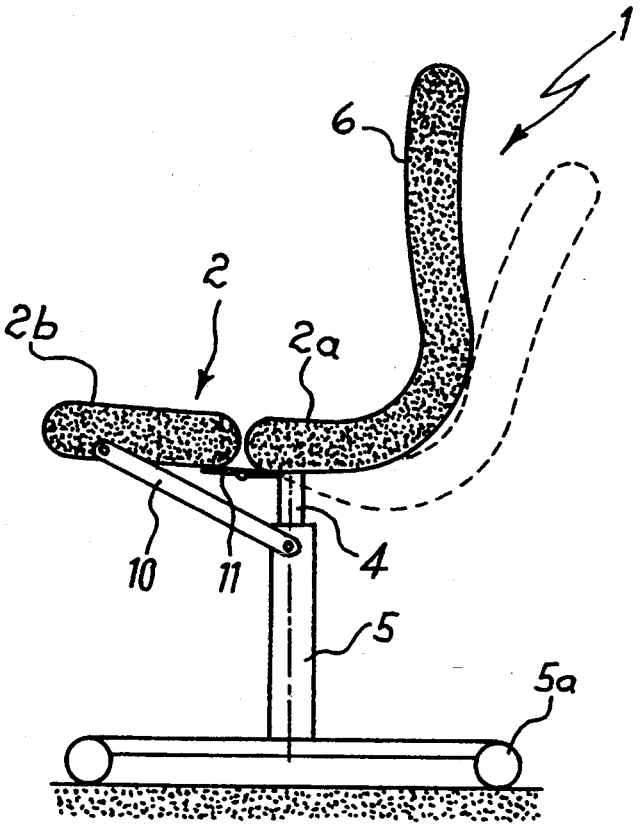
FIG. 7 shows an embodiment of the present invention in which the one piece portion is tiltable with respect to the vertical axis.

At it is shown in FIGS. 6*a*–6*c*, the connecting means 10 may be provided with an adjusting device to make possible the modification of the degree of the tilting angle of seat portion 2*b* as a function of the height, whereby a greater or smaller tilting of front side 2*b* can correspond to the same height of the whole seat 2. For instance, according to FIG. 6*a*, the linked arm 10*a* has, at one end thereof, an articulated plate or link rod 8*a* which is fixable at different angles, thereby causing the length of arm 10*a* to correspondingly increase until a maximum length obtained by the alignment with plate 8*a*. In FIG. 6*b* such a changing is obtained by means of a pin fixable within a slot 8*b* of linked arm 10*b*, the length of which slot 8*b* corresponds to the maximum change obtainable. In FIG. 6*c* the arm is instead replaced in practice by a piston-cylinder system 10*c* wherein piston 8*c* can be made integral, by known means, with cylinder 7*c*, from a position in which it is fully retracted until a position of full projection corresponding to a maximum length. Now it is clear that a person of small height will adjust the length of connecting means 10 at the lower values thereof, thereby causing anyhow a greater donward tilting of front portion 2*b* to correspond to a changing in height of the seat, whereas the contrary will occur for a taller person. If the chair is always used by the same person an adjustment of this kind may be carried out once and for all, obviously without excluding that in particular circumstances the user can modify at his will the way in which the slope of the seat changes with the height thereof.

The chair 1 of FIGS. 4*a*–6C has been represented without armrests, but it is clear that armrests could be provided, possibly adjustable in height, as well as the backrest, according to the embodiments of FIGS. 2, 3, with the seat rear portion integral with the backrest, thus providing for a chair or armchair ergonomically improved also in this respect. Furthermore means different from those represented can be adopted to accomplish the automatic slope changing of a seat front portion as a function of the height thereof and to modify such a variation law, and/or for adjusting the height of the backrest together with the armrests.

It is claimed:

1. A chair adjustable as to the height, comprising a one-piece portion vertically movable with respect to a fixed base, said one-piece portion comprising a backrest portion and integrally therewith a seat rear portion of a seat, and a seat front portion of the seat, said seat front portion hinged to said seat rear portion, whereby said seat front portion is downwardly tiltable with respect to said seat rear portion, and a means for automatically adjusting the tilting angle of said seat front portion as a function of the height of said one-piece movable portion.

2. The chair according to claim 1, wherein the automatic adjusting means comprises a means for connecting the seat front portion to the fixed base.

3. The chair according to claim 2, wherein the connecting means is a linked arm.

4. The chair according to claim 3, wherein the linked arm is adjustable by the user.

5. The chair according to claim 4, wherein the linked arm is hinged at a first end to said fixed base and at a second end to said seat front portion, the linked arm comprising an extension arm adjustably hinged at one end thereof to the second end of the linked arm and at a second end of the extension arm to the seat front portion, whereby the working length of the linked arm can be variably fixed by adjusting a hinge angle of the extension arm.

6. The chair according to claim 4, wherein the linked arm is hinged at a first end to the fixed base, and is connected to the seat front portion by way of a slot located towards a second end of the linked arm, whereby the working length of the linked arm is adjustable and is dependent on the position of a connecting point within the slot.

7. The chair according to claim 2, wherein the connecting means comprises an adjustable cylinder and piston arrangement operable by a pressure means, wherein the full working length of the connecting means is determined by the total of the length of the cylinder and the length of a portion of the piston projecting therefrom at a given fixable stroke position.

8. The chair according to claim 1, wherein the one-piece portion is tiltable.

9. The chair according to claim 1, wherein the one-piece portion further comprises a pair of armrests fixed thereto, such that a vertical adjustment of the one-piece portion brings about a corresponding adjustment to the pair of armrests.

10. The chair according to claim 9, wherein the one-piece portion and the pair of armrests are integral.

11. The chair according to claim 9, wherein the armrests are connected to the one-piece portion through armrest connecting means allowing for the removal of the armrests.

12. The chair according to claim 11, wherein said armrest connecting means comprises a pair of sleeves fixed to the one-piece portion, which sleeves removably receive a pair of posts supporting the armrests.

* * * * *